United States Patent [19]

Gatti et al.

[11] 3,960,303

[45] June 1, 1976

[54] METHOD AND APPARATUS FOR STABILIZING A LONGITUDINALLY MOVING WEB OF MATERIAL

[75] Inventors: Raimondo Gatti, Gallarate, Italy; Franz Josef Gierse, Wickrathberg, Germany

[73] Assignee: Franz Muller Maschinenfabrik, Monchen-Gladbach, Germany

[22] Filed: Oct. 4, 1973

[21] Appl. No.: 403,430

[30] Foreign Application Priority Data

Nov. 18, 1972 Germany ..... 2256638

[52] U.S. Cl. ..... 226/1; 226/195

[51] Int. Cl.[2] ..... B65H 23/04

[58] Field of Search ..... 226/95, 97, 195, 196, 226/94, 1, 198, 199; 242/75.2; 26/54

[56] References Cited

UNITED STATES PATENTS

| | | | |
|---|---|---|---|
| 2,264,683 | 12/1941 | Smith | 226/196 UX |
| 2,273,565 | 2/1942 | Euth | 226/199 X |
| 2,778,634 | 1/1957 | Gams | 226/95 |
| 2,906,527 | 9/1959 | Blain | 226/199 X |
| 2,991,502 | 7/1961 | Becker | 226/196 X |
| 3,174,669 | 3/1965 | Zernov | 226/195 X |
| 3,398,870 | 8/1968 | Mullan | 226/97 |
| 3,417,484 | 12/1968 | McCarty | 226/97 X |
| 3,436,853 | 4/1969 | Buss | 26/54 X |
| 3,472,439 | 10/1969 | Eastcott | 226/195 |
| 3,514,024 | 5/1970 | Hawkins | 226/97 |
| 3,606,120 | 9/1971 | Wyatt | 226/195 |

*Primary Examiner*—Richard A. Schacher
*Attorney, Agent, or Firm*—Herbert L. Lerner

[57] ABSTRACT

In stabilizing a longitudinally moving web of material, particularly as utilized in textile machinery, the moving web of material is guided along a smooth, rigid surface and an underpressure is created between the moving web of material and the rigid surface to stabilize the moving web.

3 Claims, 4 Drawing Figures

METHOD AND APPARATUS FOR STABILIZING A LONGITUDINALLY MOVING WEB OF MATERIAL

This invention relates to a method for stabilizing a longitudinally moving web of material as well as to apparatus for implementing the method, particularly as utilized in textile machinery. The term "stabilizing" as used herein has a general meaning and is to be understood to cover, besides smoothing an unstably running web of material in the plane of the web (stabilizing in the normal direction), also, among other things, the lateral guidance for centering, that is, the prevention of lateral traveling back and forth of the web of material (stabilizing in the lateral direction).

In the course of mechanization, it is desirable to run machines for handling and processing webs of material, for example, winding machines, singeing machines for webs of material, cutting machines such as corduroy and velvet cutting machines, as fast as possible. In this connection, provision must be made, as a rule, that the web of material runs quietly and that it be smoothed-out at the processing station, in spite of its high velocity, and without lateral motion. Webs of textile material are therefore handled or guided in such machines by various kinds of oscillating rollers, edge-smoothing rollers, or the like. With increasing velocity of the material, however, these means stress the web of material mechanically so severely that limits are set for the material velocity, if only for reasons of wear or damage to the material. It has furthermore been found that the known means which influence the web of material actively, can fulfill their function in the desired manner only up to a certain material velocity because of the mass inertia and the inertia of the electrical control. Otherwise, the active means for stabilizing the web of material, if designed for increasingly higher material velocities, become more and more expensive, so that the effectiveness of the mechanization becomes doubtful.

It is, therefore, an object of the present invention to create means for stabilizing, that is, among other things, for smoothing out and, if required, centering a fast-running web of material, which still performs its function in a satisfactory manner also at higher velocities, for example, above 200 m/min up to at least 700 m/min, while avoiding expensive control means and directing particular attention to guiding the web of material in a wear-minimizing manner. The aforementioned objective is achieved by guiding the web of material to be moved directly along a smooth, rigid surface in such a manner that underpressure develops between the web of material and the surface.

Contrary to known, active means for stabilizing webs of material, passive components, also called "stabilizing surface" in the following description, are thus involved, according to the invention, which influence the web of material in the desired manner without any mechanical movement or even control. At relatively high material velocities, of for instance, more than 200 m/min, underpressures in the order of the area weight of the material, depending on the velocity of the material, are generated between the web of material and the rigid surface according to the invention. The width of the web of material is essentially without influence here because the area in which the underpressure in the air gap between the web of material and the surface equals the ambient pressure, extends to a comparatively narrow strip at the edge in the order of only a few centimeters. However, the longitudinal length of the surface, measured in the direction of travel of the material, is of some importance. Such longitudinal surface should be so long that the underpressure existing between it and the web of material, as a rule in cooperation with the force of gravity, is sufficient to flatten out, in a manner of speaking, waves, frequently standing waves, which form upon entering on the surface. If the instability of a web of material manifests itself mainly in such waves, it is usually sufficient if the stabilizing surface has a flat region (the smoothing region), whose length, as measured in the direction of travel of the material, corresponds to about two or three wavelengths. In general, the necessary length of the surface depends, besides on the type, also on the way in which the instability of the web of material was generated or how it manifests itself and also on the velocity of the material.

According to a further feature of the invention, however, the wave motion mentioned can be prevented practically completely if the stabilizing surface consists, at least on the side facing the web of material, of electrostatically chargeable material. This provision includes the case in which the stabilizing surface or plate is made solidly of such insulating material.

As a result of the fast passing of the web of material at the insulating stabilizing surface, static electricity is generated, that is, a separation of positive and negative charges, so that the stabilizing surface and the web of material assume different electric charges and attract each other electrically. To the advantageous effect of the underpressure of the stabilizing surface is therefore added an electrostatic attraction force between the web of material and the stabilizing surface. This additional electrostatic attraction force, together with the force of the underpressure, is so effective that a web of material running onto the stabilizing surface runs smoothly over the surface almost from the start, even under the most unfavorable conditions as in the case, for example, where a web of material is pulled from a rest position in a pile of material directly onto the rigid stabilizing surface at 700 m/min or more. The reason for this is, among other things, that the electrostatic charge and, of course, the effects of the underpressure, increase with the velocity of the material.

The stabilizing surface can be covered or coated smoothly with insulating material or may consist of such material. Suited for this purpose are materials which can be produced in the form of smooth films or panels and which can be charged electrostatically by friction, for instance, plastic or glass.

Through the insulating layer, the surface of the stabilizing surface can be made extremely smooth and flat in a simple manner so that the insulating layer results not only in the electrostatic attraction force between the web of material and the surface, but also in an increase of the attraction force by the underpressure.

The inclination of the stabilizing surface and, in particular, the inclination of its plane stabilizing region against the vertical can largely be fitted to the respective other requirements or to the available space in the machine. The surface can therefore assume any angle of inclination between 0° and 90° against the vertical.

It is often advantageous to mount the rigid stabilizing surface in such a way that the side of the web of material to be processed in the further course of the machine is facing away from the rigid surface or surfaces which smooth and/or straighten the web of material.

Further advantageous embodiments of the subject of the invention are described in the claims. In a device for implementing the method according to the invention, it is advantageous if the rigid stabilizing surface is an essentially flat panel with a curved entrance region which is shaped in view of the optimum effectiveness of the method. The method has its optimal effectiveness if the development of the underpressure in the air gap between the web of material and the rigid surface is favorable in view of the purpose of the underpressure, namely, to stabilize the web of material. Preferably, a rigid, smooth surface or plate, along which the path of the web of material is directly guided, can be provided approximately parallel to the web of material, which moves in operation, while the entrance region assumes at the same time the function of deflecting the web of material, at least in part.

Surprisingly, a web of material, no matter how unstably it arrives at the surface or plate according to the invention, runs stably and smoothly at the end of the surface. It is advantageous in this connection if the surface has a curved entrance region and if the separation region at the end of the surface is mechanically defined in some manner. To this end, a mechanically defined transversal line, for instance, a slot or a step, can be provided shortly before the end of the surface, as seen in the direction of travel of the web of material.

The method according to the invention and the device for implementing the method with the further advantageous embodiments and improvements set forth in the claims are so effective that even a web of material pulled directly over the rigid stabilizing surface from the rest position in a stack of material at, for instance, 700 m/min leaves this surface in a stable, smooth run.

The new method is therefore particularly well suited for velvet or fine corduroy cutting machines where an endless web of material must run past the cutting device and, therefore, through the entire machine as many times as there are ribs to be cut in the web of material. Depending on the width of the web of material and the density of the ribs to be cut, revolutions in the order of 1000 to 2000 revolutions of the web of material are made, so that in velvet cutting machines, the wear-minimizing guidance of the web is particularly noticeable if the method according to the invention is used. As in velvet cutting machines, endless material sections of several hundred meters in length are processed as a rule, the web of material is stored at each revolution in a J-box, in which the web of material is stored on the one side, and from which it is withdrawn at the other end. In such machines it is therefore necessary to accelerate a web of material suddenly from the rest position in the J-box to the full machine velocity. Even the web of material which arrives from the J-box at the stabilizing surface very unstably leaves the stabilizing surface, according to the invention, practically completely smoothly. The method according to the invention has therefore proven itself especially in velvet cutting machines.

While in some high-speed machines, for example, singeing machines, the smoothing-out of a web material arriving unstably before the treatment, that is, stabilizing in the direction normal to the web of material, is important, greatest stress is placed in other machines, for example, velvet cutting machines, on the requirement that the web of material is guided straight without running back and forth sideways, that is, that it is centered. This stabilization in the lateral direction can also be achieved with the method and the devices for implementing the method according to the invention, if the rigid stabilizing surface is a deflection surface curved in the direction of travel of the material. Underpressure and, possibly, an electrostatic attraction force develops also between such a curved deflection surface and the web of material. However, these forces are opposed by the centrifugal force. This force, which is larger for smaller radii of curvature of the surface and which increases as the square of the material velocity, is furthermore opposed by the longitudinal tension forces in the web of material. If the centrifugal force, therefore, gets to be in the order of magnitude of the opposing forces, that is, the longitudinal tension forces in the web of material, the underpressure as well as the electrostatic attraction force between the web of material and the surface and, possibly, the force of gravity, then the web of material will float freely above the curved surface. A contactless deflection surface is thus obtained, which fully meets in an ideal manner one of the objectives stated above, namely, careful handling of the material, often without the additional electrostatic attraction force.

The mechanism can further be understood from the following description. If all the forces acting in the vicinity of the deflection surface are constant in time and at equilibrium, the web of material can move on the curved surface without contact upon the deflection surface, provided the force conditions and the material velocities are right. The radius of curvature of this web adjusts itself then in dependence on the material velocity as the equilibrium between the centrifugal force, on the one hand, and the longitudinal tension forces, the underpressure and, if applicable, the electrostatic attraction force and the force of gravity. If the web of material is pulled over the deflection surface with constant velocity and force in the travel direction of the material, the corresponding influence factors, including the underpressure and the force of gravity, can actually also be considered as constant in time. Something different, however, applies as a rule to the tension force acting in the direction opposed to the travel of the material, that is, the tension force acting from the direction of the entrance to the curved surface. This force can be assumed to vary to a greater or lesser degree. It is therefore advantageous, and in many cases important, that the curved deflection surface is preceded by the rigid surface described above. The latter surface already stabilizes the web of material, approximately functioning as a vibration damper, to such an extent that the tension forces against the direction of travel of the material become accordingly constant, and the abovementioned equilibrium of forces essentially adjusts itself at the curved deflection surface.

Under these circumstances the curved deflection surface can be designed to advantage also for the stabilization in the lateral direction, that is, for straightening or centering the web of material. If the web of material is guided, particularly after first being stabilized in the normal direction and with the equilibrium of forces suitably adjusted as explained above, largely without contact, over such a curved deflection surface, it can easily be moved laterally.

For stabilization in the lateral direction, it is therefore sufficient if, according to a further feature of the invention, the curved deflection surface is provided with raised edges, the spacing of which corresponds to the width of the web of material as accurately as possible. The web of material is then guided on an exactly straight line between these two edges. It may, however, also be advantageous if the deflection surface has a convex shape not only in the direction of travel of the material, but also transversally thereto, particularly if the width of the material varies. Such a shape, technically called "knobbing" is sufficient to center or align a web of material in an excellent manner. The deflection surface can be a rigid, straight, or curved bar. It may also be advisable, for instance, if high and low velocities are to be run alternatingly, to design the deflection surface as a revolving or rotatable cylindrical or crowned roller. The web of material then seeks to run in the center of the surface, which may be curved. Should the web of material run sideways prior to running onto this surface, the web can shift into the center of the surface without difficulty in a manner known per se. Depending on the other requirements of the design, several curved deflection surfaces may be provided with or without means for lateral guidance of the web of material.

As in the method according to the invention, the stabilization of the web of material is caused by, among other factors, the underpressure produced between the web of material and the plane part of the rigid surface as well as by the electrostatic attraction force, but as these forces assume even at high material velocities (in the case of the underpressure, depending on the air permeability of the web of material only relatively small absolute values, for example, at 600 m/min, only in the order of the weight of the material or more, major air movements or air shocks such as, for example, caused by the vacuum cleaning system of the machine, may in some cases interfere with the advantageous interaction, according to the invention, between the web of material and the plane surface. It may then be advantageous to provide a second surface or panel with spacing on that side of the moving web of material which is opposite the plane surface. This plate should, however, be spaced or removed from the first one so far, and/or be perforated, that contact between it and the web of material either is impossible, or that upon contact with the web of material, underpressure or electrostatic attraction forces cannot develop appreciably. It is often sufficient in this case if the second surface or panel is placed opposite the first one only in that region, that is, the smoothing region, in which the forces developing between the first surface or panel and the web of material are utilized for smoothing out the surface of the web of material. It may, on the other hand, be advantageous, particularly if strong external air drafts are to be expected, to connect the longitudinal edges of the two opposite plates on both sides of the longitudinal edges of the material, so that a flat, long, rigid channel is formed.

Surprisingly, the sidewalls of the channel can also be used to center the web of material already smoothed out on the stabilizing surface in such a way that the web of material leaves the stabilizing surface not only smoothed out but also free of lateral swaying. A particularly advantageous further embodiment of the subject of the invention, therefore, is to provide the rigid, plane surface, particularly in the separation region of the web of material, with sidewalls whose distance from each other is, or can be, matched to the width of the web of material.

Other features which are considered as characteristic for the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings, in which.

Figure 1:
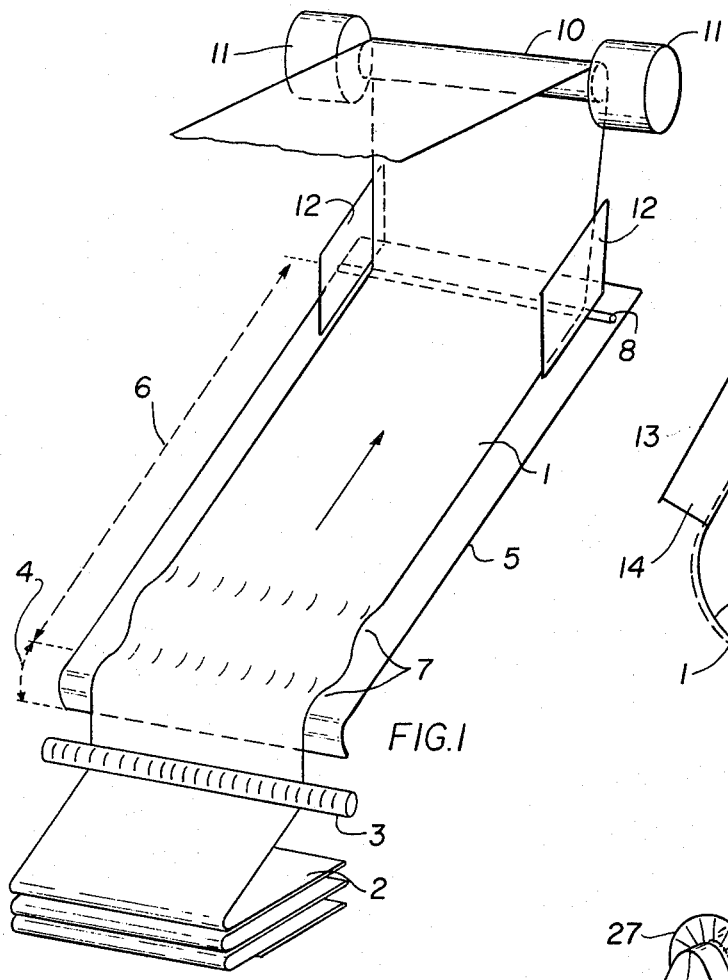
FIG. 1 is a schematic and perspective view of a stabilizing apparatus according to one embodiment of the invention.

Referring to the drawings, there is shown a web of material 1 which is drawn from a pile of material 2 in the direction of the arrow shown in FIG. 1. The web of material 1 is driven by a pulling cylinder, for example as indicated by the numeral 16 in FIG. 2. In the illustrated embodiment, the web passes via a guide bar 3, according to FIG. 1, or between guide bars 3, 3' according to FIG. 2, to a curved entrance region 4 of a rigid surface 5 which is a tangential continuation of the entrance region 4. The curved entrance surface ensures that the web of material 1 moves onto a plane smoothing region 6 of the rigid surface 5 in a reasonably smooth manner from the start. In running or passing over the smoothing region 6, which is designed as a plane surface, at high speed, for example 200 to 700 m/min, underpressure develops between the surface 5 and the web of material 1, which smoothes out waves 7 formed in the web of material if the latter enters in an unstable condition.

In the example of the embodiment according to FIG. 1, the waves 7 are produced by withdrawing the zigzag layers from the pile 2. For the stabilizing or smoothing out, by means of the underpressure, and possibly in conjunction with the force of gravity, it has been found that a length of the surface 3 is sufficient which corresponds to about 2½ wavelengths. If the stabilizing surface is covered or coated with insulating or electrostatically chargeable material, or consists of such material, smoothing of the web of material will occur still considerably faster, that is, practically instantaneously.

At the end of the surface 5, the web of material 1 runs smoothly up to a transversal separation line 8, which may be, for example, a wire soldered to the surface 5 (FIG. 1) or a step (FIG. 2), at which the underpressure conditions between the surface 5 and the web of material 1 change abruptly, so that at this straight transversal line 8, the web of material separates in a defined manner from the surface 3 and makes contact with the following surface due to the tension exerted on the web of material 1. Making the transversal line 8 a step (FIG. 2) has the advantage that the web of material 1 can be drawn off tangentially from the surface 5, and the separation region is thereby defined particularly well. The step can also be identical with the end of the surface 5.

Figure 2:
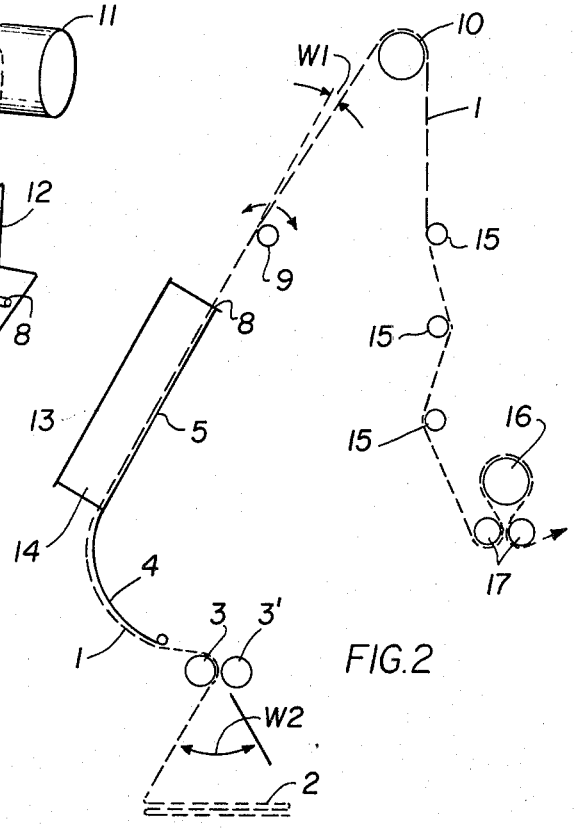
FIG. 2 is a schematic and elevational view of an alternate stabilizing apparatus.

In FIG. 2, the web of material 1 runs, after separation from the surface 5, onto another surface, which is a bent bar 9 in the manner of a bent, standing width-holding bar, whose curvature acting on the web of material 1 is adjustable by turning the bar 9 in the direction of the arrow. This bar 9 therefore constitutes a curved deflection surface, according to the invention, past which the web of material 1 slides largely without contact due to the centrifugal force, but is always oriented by the curvature of the bar and is thereby guided straight. If the bar 9 is turned so that it forms a surface curved convex transversely to the direction of travel of the material, it is therefore, according to the invention, an advantageous means for guiding the web of material 1 straight and centering it.

In the example of the illustrated embodiment, the web of material 1 runs over another curved deflection surface 10 following the bar 9. This surface 10 itself, for example, is in the form of a stationary tube with a contact angle of 180° or more and is an ideal means for the wear-saving deflection of a web of material 1 as the web slides over this surface largely without contact if the velocities, as described above, are sufficient.

In FIG. 1 there is shown an example therein whereby this curved deflection surface 10 may have raised steps 11 on the sides, and wherein such steps 11 are separated a distance from each other equal to the width of the web of material 1. If, therefore, no other lateral guidance or straightening means are provided in the device, or if additional such means are required, these raised steps 11 can be used, according to the invention, for straightening and centering the web of material 1.

The stabilizing surface 5 itself can also be designed so that it is suited for straightening the running of the web of material 1, in addition to smoothing it out. To this end, it is only necessary to arrange on the surface 5, perpendicular steps or plates 12 spaced from each other a distance equal to the width of the web of material. It is often sufficient if, as shown in FIG. 1, the plates 12 are present only in the separation region of the surface 5.

To protect the interactive mechanism between the web of material 1 and the surface 5, a surface 13 may also be disposed opposite the surface 5 at a relatively large distance as schematically shown in FIG. 2. In FIG. 2, the lengthwise edges of the surfaces 5 and 3 are furthermore closed by means of sidewalls 14, so that a channel is provided in which the web of material 1 is stabilized, in accordance with the invention, at the surface 5 and protected against external disturbances. If the mutual spacing of the sidewalls 14, particularly in the separation region of the surface 5, is matched to the width of the web of material, the sidewalls 14 can also be utilized as means for straightening or centering the web of material 1.

In the example of the embodiment according to FIG. 2, the web of material 1 leaves the rigid surface 5 tangentially and continues to the deflection surface 10 via the bent bar 9. The web of material 1 is looped over the surface 10, which may be a stationary tube, in a sense different from that in FIG. 1. This is advantageous, if the web of material is to have as little contact as possible on one side. The web of material is deflected only by a relatively small angle W1 at the bar 9, which acts in the manner of an alignment rod. Small deflection angles mean correspondingly small contact angles at the bar 9. At the high visualized material velocities of 200 m/min and more, the bar 9 can fulfill its purpose, that is, the centering of the web of material 1 with small contact angles. After leaving the deflection surface 10, the web of material 1 in FIG. 2 runs between guiding rods 15 to the pulling cylinder 16 which is preceded and followed by guide rollers 17.

It may be advantageous if, in the lifting of the web of material 1 from a pile 2, the distance between the upper edge of the pile 2 and the guide bar 3, 3' at the entrance to the surface 5 is so large that the drawing-off angle W2 is relatively small, for example 90° or less. Accordingly, in view thereof, the instability with which the web of material 1 passes to the surface 5 has a correspondingly small amplitude.

Figure 3:
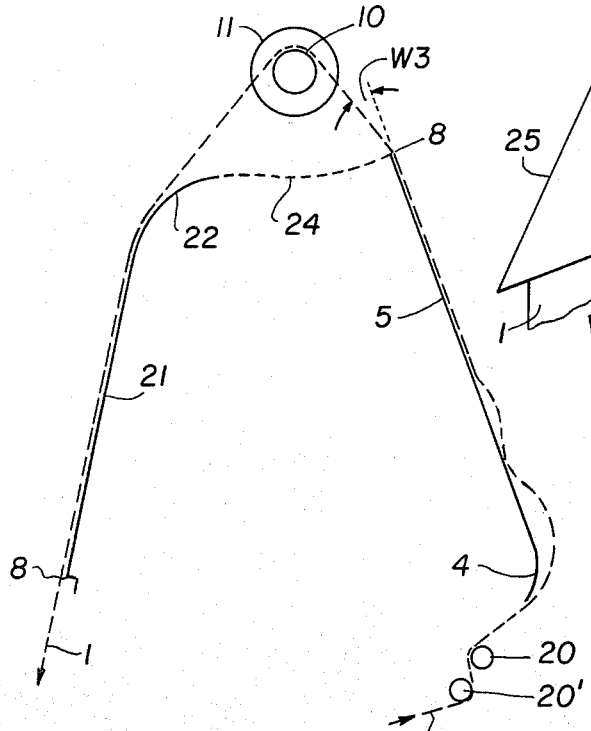
FIG. 3 is a schematic and elevational view of another embodiment of the stabilizing apparatus.

An example of an alternate embodiment is shown in FIG. 3. In FIG. 3, guide bars 20, 20' are located at the entrance and are situated on top of each other. This is in contrast to the bars 3, 3' in FIG. 2. The guide bars 20, 20' are thereby given a function similar to that of a material tensioner for pulling off relatively low-tensioned material. In the FIG. 3 embodiment, the supply need not come from a pile as it does in the other illustrated embodiments. In FIG. 3, the parts 5, 8 and 10 correspond essentially to those of FIGS. 1 and 2. In order to utilize the surface 5 optimally for stabilizing the web of material 1, the web 1 is drawn off downwardly inclined from the plane of the surface 5 by the small angle W3. After leaving the deflection surface 10, the web of material 1 in FIG. 3, however, does not run over guide bars (for example guide bars 15 in FIG. 2), but over a rigid surface 21 which essentially corresponds to the surface 5 and which preferably likewise has an entrance region 22. In the arrangement according to FIG. 3, stabilizing surfaces are therefore provided ahead and after the deflection surface 10, the first surface 5 stabilizing the web of material 1 in the normal direction, as in the prior illustrated embodiments, and the second surface 21 being suitable for stabilizing the web of material 1 in the lateral direction. For mechanical stability, the two surfaces 5 and 21 may also be connected rigidly to one another, as indicated by the broken line 24 in FIG. 3.

Figure 4:
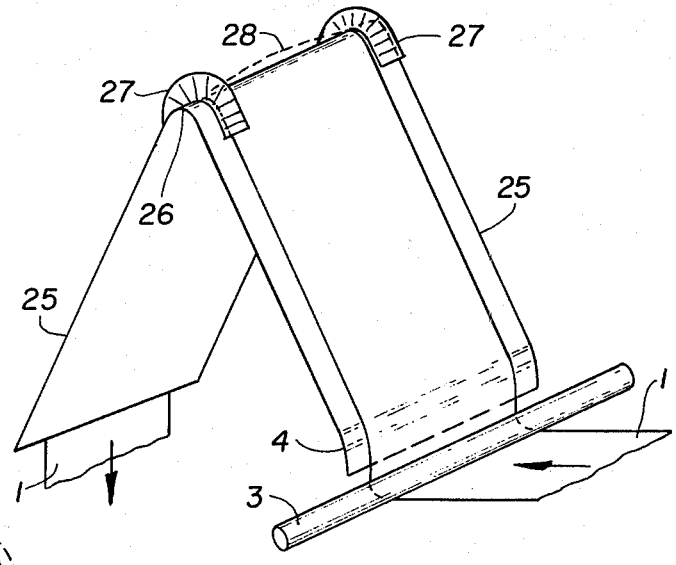
FIG. 4 is a schematic and perspective view of a further alternate embodiment.

In a further alternate embodiment according to FIG. 4, the two stabilizing surfaces 5 and 21 as well as the deflection surface 10 are combined into a unit 25 which consists, for example, of a suitably formed sheet of metal. In FIG. 4, deflection part 26 and the surface 25 may have, as in the case of steps 11 in FIG. 1, raised edges or lateral surfaces 27, the spacing of which can be fitted to the width of the web of material. Instead, or in addition, the deflection member 26, which is convex in the direction of travel of the material, may also be convex transversely to the direction of travel of the material as represented by the dashed line 28 in FIG. 4, so that the entire surface 25 also assumes the function of the bar 9 of FIG. 2. The surface 25 can, of course, also end following the region 26, which takes over the function of the deflection surface 10 as in FIGS. 1 and 2, so that the region with the function of the rigid surface 21 as in FIG. 3 is eliminated.

We claim:

1. A method for stabilizing a web of textile material moving unstably in longitudinal direction thereof comprising:

guiding the web onto a smooth, rigid and flat surface defined by means formed of electrostatically chargeable material; and moving the web along the surface at a velocity exceeding 200 meters per minute at which an underpressure is created between the web of textile material and the smooth, rigid and flat surface, and the web is electrostatically attracted to said surface, whereby the moving web of material is stabilized on the smooth, rigid and flat surface.

2. An apparatus for stabilizing a web of textile material moving unstably in longitudinal direction thereof comprising:

means defining a smooth, rigid and flat surface formed of electrostatically chargeable material at least on the side thereof facing the moving textile web; and means for driving the textile web at a speed of at least 200 meters per minute so as to create an underpressure between the moving textile web and said flat surface whereby the moving textile web is stabilized on said surface.

3. An apparatus according to claim 2 including means for guiding the textile web onto said flat surface; and wherein said flat surface extends in the longitudinal direction of the textile web a length equal to from two to three wavelengths of a standing wave forming in the textile web as the web is guided onto said flat surface.

* * * * *